US009332331B2

(12) United States Patent
Li

(10) Patent No.: US 9,332,331 B2
(45) Date of Patent: May 3, 2016

(54) DATA PROCESSING METHOD AND AN ELECTRONIC APPARATUS

(71) Applicant: Lenovo (Beijing) Co., Ltd., Beijing (CN)

(72) Inventor: Jia Li, Beijing (CN)

(73) Assignee: LENOVO (BEIJING) CO., LTD., Haidian District, Beijing (CN)

( * ) Notice: Subject to any disclaimer, the term of this patent is extended or adjusted under 35 U.S.C. 154(b) by 253 days.

(21) Appl. No.: 13/970,837

(22) Filed: Aug. 20, 2013

(65) Prior Publication Data

US 2014/0050333 A1 Feb. 20, 2014

(30) Foreign Application Priority Data

Aug. 20, 2012 (CN) ..... 2012 1 0298169

(51) Int. Cl.
*H04R 3/00* (2006.01)
*H04R 1/08* (2006.01)

(52) U.S. Cl.
CPC ..... *H04R 1/08* (2013.01); *H04R 3/005* (2013.01); *H04R 2499/11* (2013.01)

(58) Field of Classification Search
CPC .... H04R 3/005; H04R 1/406; H04R 2203/12; H04R 2430/20; H04M 1/6041; H04M 1/605; H04M 2250/12; H04S 7/303
USPC ..... 381/92
See application file for complete search history.

(56) References Cited

U.S. PATENT DOCUMENTS

| | | | | |
|---|---|---|---|---|
| 8,174,547 | B2 | 5/2012 | Yoneda | |
| 2010/0066665 | A1 | 3/2010 | Yoneda | |
| 2013/0190041 | A1* | 7/2013 | Andrews et al. | 455/556.1 |

FOREIGN PATENT DOCUMENTS

| | | |
|---|---|---|
| CN | 101676861 | 3/2010 |
| CN | 102045618 | 5/2011 |
| EP | 1 349 419 | 10/2003 |

OTHER PUBLICATIONS

First Office Action dated Jan. 19, 2016 out of corresponding Chinese priority Application No. CN 201210298169.0 (10 pages including English translation).

* cited by examiner

*Primary Examiner* — Paul S Kim
*Assistant Examiner* — Norman Yu
(74) *Attorney, Agent, or Firm* — Brinks Gilson & Lione; G. Peter Nichols

(57) ABSTRACT

A data processing method and an electronic apparatus are described. The hand-held electronic apparatus has a microphone array that includes at least two kinds of usage modes. The microphone array is in a first usage mode of the at least two kinds of usage modes when the hand-held electronic apparatus is in a first usage status. The method includes receiving an adjustment signal to adjust the hand-held electronic apparatus from the first usage status to a second usage status, wherein, the second usage status is different from the first usage status; obtaining a control command when the hand-held electronic apparatus is adjusted to the second usage status; adjusting the microphone array from the first usage mode to the second usage mode according to, wherein, the second usage mode is different from the first usage mode and corresponds to the second usage status.

8 Claims, 4 Drawing Sheets

DATA PROCESSING METHOD AND AN ELECTRONIC APPARATUS

BACKGROUND

This application claims priority to Chinese Patent Application No. 201210298169.0 filed on Aug. 20, 2012, the entire contents of which is incorporated herein by reference.

The present invention relates to the electronic technology field, and particularly relates to a data processing method and an electronic apparatus.

At present, in a hand-held electronic apparatus such as mobile phone, there are usually built-in microphones for receiving sound information of a user to make telephony call with other users, and the microphones built in the mobile phone form microphone array, which has a relatively obvious effect on oriented collection of the sound information and eliminating the external noise or the like, for example, when user A uses the mobile phone to make a phone call, user B would have sound interference beside user A, and since the microphone array has the characteristic of oriented collection of the sound information, the mobile phone is capable of receiving the sound information of user A accurately, and would not receive the interfering sound information of user B.

The microphone array couples signals of two microphones into one signal, i.e., it forms a receiving region in front of the two microphones, so as to cut down the sound collection effect on the side of the two microphones.

And the applicant finds that in the procedure of implementing this application, the layout of the microphone array has relative limitation, according to the usage position of the user, it will be fixed in a space, which results in that the direction and position for collecting the sound can't be changed as collecting the sound, for example, when the microphone array is fixed in one end of the mobile phone, the sound information of the user can be received accurately when the mobile phone is in a usage status of vertical screen, and when the user switches the usage status of the mobile phone to horizontal screen usage, when the user is making a phone call, the source of the sound information is different from the source of the sound information when the mobile phone is in the usage status of vertical screen as shown in FIG. 1A to FIG. 1B. FIG. 1A is a schematic diagram of the user making a phone call when the mobile phone is in the usage status of vertical screen, region capable of being received by the mobile phone is illustrated in the diagram, in which the mobile phone is able to receive the sound information source of the user accurately when the user is making a phone call. And in FIG. 1B, the mobile phone is in a usage status of horizontal screen, when the user makes a phone call at this time, the sound source may be same as the sound source when the mobile phone is in a usage status of vertical screen, or may not be, when they are different, the sound source of the user will be outside the receiving region of the microphone array, therefore, the mobile phone may raise technical problems that it can't collect the sound information of the user or the collection is inaccurate.

Therefore, since the microphone array is fixed in one space, it can only receive sound signal in specified region, and once the user switches the usage scene, for example, makes speech input at the side of the microphone array, the sound collection function of the microphone array will be greatly influenced, and since the microphone array can't change the direction and position of the sound collection, there may be technical problems that the sound information can't be collected or the collection effect is poor.

SUMMARY

The present invention provides a data processing method and an electronic apparatus for solving the technical problems that the sound information can't be collected or the collection effect is poor since the microphone array can't change the direction and position of the sound collection in the prior art.

On the one hand, the present invention provides the following technical solution by one embodiment of the present invention:

A data processing method applied in a hand-held electronic apparatus, the hand-held electronic apparatus having a microphone array, the microphone array including at least two kinds of usage modes, and the microphone array being in a first usage mode of the at least two kinds of usage modes when the hand-held electronic apparatus is in a first usage status, the method comprising: receiving an adjustment signal to adjust the hand-held electronic apparatus from the first usage status to a second usage status, wherein, the second usage status is different from the first usage status; obtaining a control instruction when the hand-held electronic apparatus is adjusted to the second usage status; adjusting the microphone array from the first usage mode to a second usage mode according to the control instruction, wherein, the second usage mode is different from the first usage mode and corresponds to the second usage status.

Optionally, when there is only a first group of microphone array in the hand-held electronic apparatus, the adjusting the microphone array from the first usage mode to the second usage mode according to the control instruction is specifically: adjusting the position of the first group of microphone array from a first position to a second position according to the control instruction; generating a first mode switch instruction when the position of the first group of microphone array is adjusted to the second position; adjusting the microphone array from the first usage mode to the second usage mode according to the first mode switch instruction.

Optionally, when there are at least two groups of microphone arrays including a second group of microphone array and a third group of microphone array in the hand-held electronic apparatus, the adjusting the microphone array from the first usage mode to the second usage mode according to the control instruction specifically comprises: determining that the second group of microphone array of the at least two groups of microphone arrays is in the first usage mode according to the control instruction; adjusting the position of the second group of microphone array from a third position to a fourth position; generating a second mode switch instruction when the position of the second group of microphone array is adjusted to the fourth position; adjusting the microphone array from the first usage mode to the second usage mode according to the second mode switch instruction.

Optionally, when there are at least two groups of microphone arrays including a second group of microphone array and a third group of microphone array in the hand-held electronic apparatus, the adjusting the microphone array from the first usage mode to the second usage mode according to the control instruction further comprises specifically: determining that the third group of microphone array of the at least two groups of microphone arrays is in the second usage mode according to the control instruction; adjusting the third group of microphone array to be in enabled status when the third microphone array is detected; generating a third mode switch instruction when the third group of microphone array is in the enabled status; adjusting the microphone array from the first usage mode to the second usage mode according to the third mode switch instruction.

Optionally, after adjusting the third group of microphone array to be in the enabled status, the method further comprises step of: adjusting the second group of microphone array to be in disabled status.

On the other hand, the present invention provides by another embodiment of this application:

A hand-held electronic apparatus is provided, the hand-held electronic apparatus having a microphone array, the microphone array including at least two kinds of usage modes, and the microphone array being in a first usage mode of the at least two kinds of usage modes when the hand-held electronic apparatus is in a first usage status, the hand-held electronic apparatus including: a receiving unit for receiving an adjustment signal to adjust the hand-held electronic apparatus from the first usage status to a second usage status, wherein, the second usage status is different from the first usage status; an obtaining unit for obtaining a control instruction when the hand-held electronic apparatus is adjusted to the second usage status; an adjusting unit for adjusting the microphone array from the first usage mode to a second usage mode according to the control instruction, wherein, the second usage mode is different from the first usage mode and corresponds to the second usage status.

Optionally, when there is only a first group of microphone array in the hand-held electronic apparatus, the adjusting unit specifically includes: a first adjusting subunit for adjusting the position of the first group of microphone array from a first position to a second position according to the control instruction; a first generating unit for generating a first mode switch instruction when the position of the first group of microphone array is adjusted to the second position; a second adjusting subunit for adjusting the microphone array from the first usage mode to the second usage mode according to the first mode switch instruction.

Optionally, when there are at least two groups of microphone arrays including a second group of microphone array and a third group of microphone array in the hand-held electronic apparatus, the adjusting unit specifically includes: a first determining unit for determining that the second group of microphone array of the at least two groups of microphone arrays is in the first usage mode according to the control instruction; a third adjusting subunit for adjusting the position of the second group of microphone array from a third position to a fourth position; a second generating unit for generating a second mode switch instruction when the position of the second group of microphone array is adjusted to the fourth position; a fourth adjusting subunit for adjusting the microphone array from the first usage mode to the second usage mode according to the second mode switch instruction.

Optionally, when there are at least two groups of microphone arrays including a second group of microphone array and a third group of microphone array in the hand-held electronic apparatus, the adjusting unit further includes specifically: a second determining unit for determining that the third group of microphone array of the at least two groups of microphone arrays is in the second usage status according to the control instruction; a fifth adjusting subunit for adjusting the third group of microphone array to be in enabled status when the third microphone array is detected; a third generating unit for generating a third mode switch instruction when the third group of microphone array is in the enabled status; a sixth adjusting subunit for adjusting the microphone array from the first usage mode to the second usage mode according to the third mode switch instruction.

Optionally, the adjusting unit further includes a seventh adjusting subunit for adjusting the second microphone array to be in disabled status.

One or more technical solutions in the above-described technical solution have the following technical effects or advantages:

The above one or more of embodiments is able to change the direction and position of the sound collection at any time according to the usage status of the hand-held electronic apparatus by obtaining a control instruction when the usage status of the hand-held electronic apparatus changes and adjusting the usage mode of the microphone array according to the control instruction in real time, so that it can ensure the best effect achieved as collecting the sound information at any position.

Further, when the usage modes of the microphone array are adjusted, there are various adjusting manners, and it is possible to select different adjusting manners according to different situations, which has a technical effect of flexible selection.

DETAILED DESCRIPTION

In order to solve the technical problems that the sound information can't be collected or the collection effect is poor for the microphone array can't change the direction and position of the sound collection in the prior art, the present invention provides a data processing method and an electronic apparatus, of which the general concept of solution is as follows:

The change of the position of the microphone array is controlled and further the change of the acceptance region of the microphone array is controlled by providing a direction sensor in the hand-held electronic apparatus, and further, when the change of the status of hand-held electronic apparatus is detected, the usage mode of the microphone array is switched by obtaining a control instruction to improve the ability of the sound collection of the hand-held electronic apparatus, to overcome the technical problems that the sound information can't be collected or the collection effect is poor for the microphone array can't change the direction and position of the sound collection in the prior art.

The main implementation principle, the specific implementation procedure and the advantageous effects achieved correspondingly of the embodiments of the present invention are described in detail in connection with the accompanying drawings of the specification.

Embodiment one:

In the embodiment of this application, it describes a data processing method applied in the hand-held electronic apparatus, the hand-held electronic apparatus having the microphone array.

Wherein, the microphone array includes at least two kinds of usage modes, and the microphone array is in the first usage mode of the at least two kinds of usage modes when the hand-held electronic apparatus is in the first usage status.

For example, the hand-held electronic apparatus such as the mobile phone can be used with horizontal screen, or can be used with vertical screen, the mobile phone is in the first usage status as being used with horizontal screen, and the mobile phone is in the second usage status as being used with vertical screen.

When the mobile phone has a horizontal screen, the microphone array has horizontal screen usage mode; and when the mobile phone has a vertical screen, the microphone array has vertical screen usage mode.

Figure 1A:
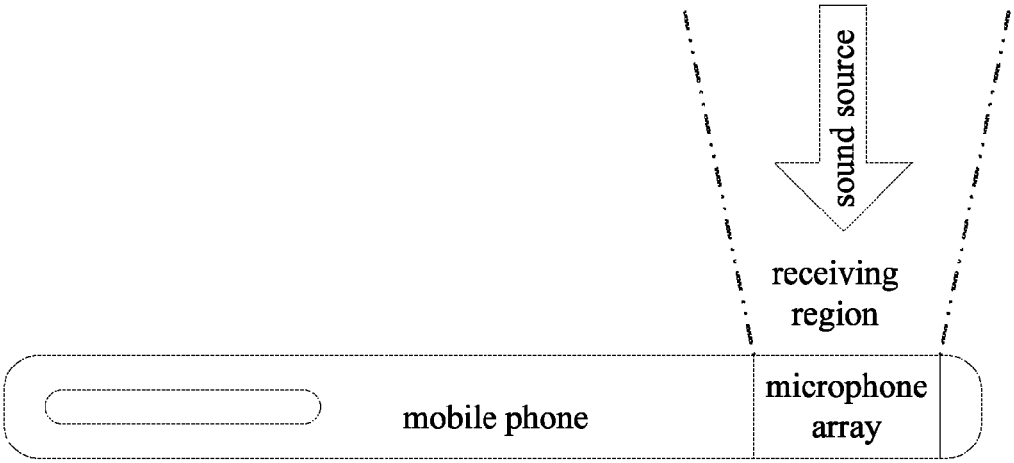
FIG. 1A and FIG. 1B are schematic diagrams of making phone call when the user collects different usage status in the prior art.
Figure 1B:
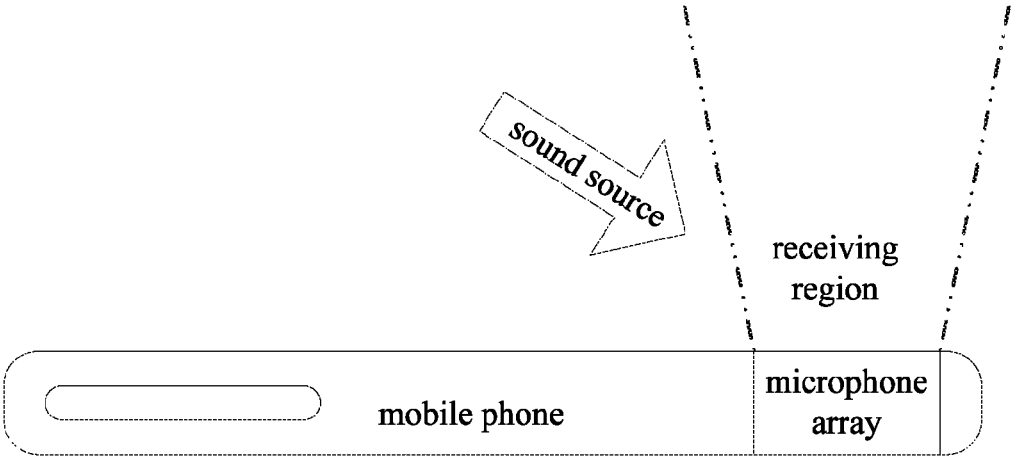
Figure 2:
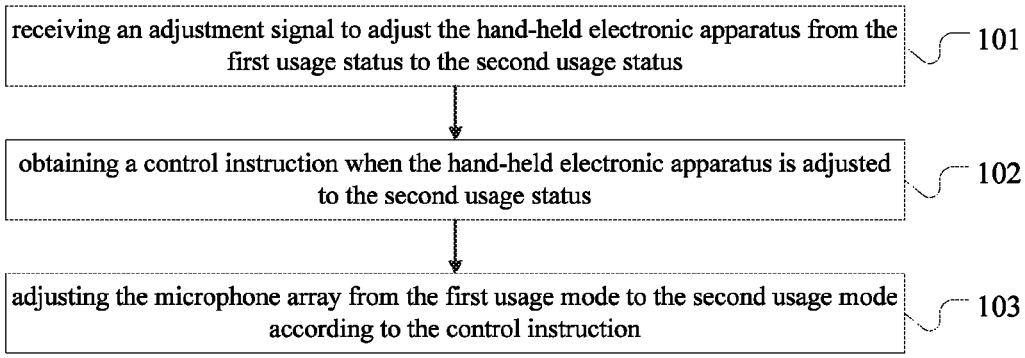
FIG. 2 is a flow chart of the data processing method in the embodiment of this application.

As shown in FIG. 2, the data processing method comprises:

Step 101, receiving an adjustment signal for adjusting the hand-held electronic apparatus from the first usage status to the second usage status.

Wherein, the second usage status is different from the first usage status;

When the user starts to use the mobile phone, the mobile phone is in vertical screen usage status, and at this time, the usage mode of the microphone array is vertical screen usage mode, and when the user makes a phone call or recording, the receiving region of the microphone faces the sound source of the user, and at this time, the microphone array can receive the sound information of the user clearly as receiving the sound information of the user, which achieves the best reception effect.

This application does not explain how to transmit the sound information to the mobile phone of the user of counterpart after the microphone receives the sound information.

If the user adjusts the mobile phone to horizontal screen usage status, at this time, an adjusting instruction would be received at the mobile phone side to adjust the mobile phone from the vertical screen usage status to the horizontal screen usage status.

Step 102, obtaining a control instruction when the hand-held electronic apparatus is adjusted to the second usage status.

When the mobile phone is adjusted from the vertical screen usage status to the horizontal screen usage status, a control instruction can be obtained according to the change of the usage status of the mobile phone.

Step 103 is executed after obtaining the control instruction.

Step 103, adjusting the microphone array from the first usage mode to the second usage mode according to the control instruction.

Wherein, the second usage mode is different from the first usage mode and corresponds to the second usage status.

If the user uses the mobile phone to make a phone call again, due to the difference of the usage status, unlike the mobile phone being in the vertical screen usage status, the sound source of the user has a certain change with respect to the mobile phone when the user is making the phone call, and at this time, in order to collect the sound information of the user better, the usage status of the mobile phone is adjusted from the vertical screen usage status to the horizontal screen usage status by the user, and a control instruction can be obtained at the mobile phone side, and it can adjust the microphone array from the vertical screen usage mode to the horizontal screen usage mode according to the control instruction, and at this time, when the user uses the mobile phone to make phone call with horizontal screen, the sound information of the user can be received clearly at the mobile phone side, which achieves the best reception effect Specifically, as to how to adjust the microphone array from the vertical screen status to the horizontal screen status, there are the following several kinds of adjusting manners with different situations according to the different number of the microphone arrays:

The first kind:

When there is only a first group of microphone array in the mobile phone.

Figure 3:
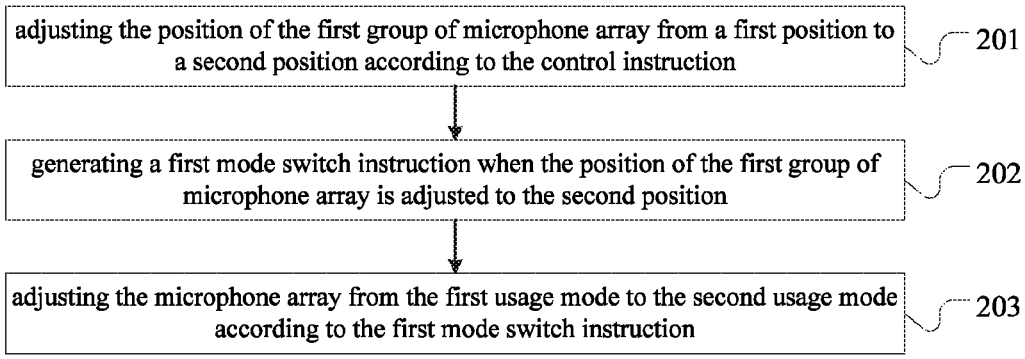
FIG. 3 is a flow chart of a method of adjusting the microphone array from the first usage mode to the second usage mode in the embodiment of this application.

As shown in FIG. 3, the adjusting microphone array from the first usage mode to the second usage mode according to the control instruction is specifically:

Step 201, adjusting the position of the first group of microphone array from the first position to the second position according to the control instruction.

Since the microphone array forms a receiving region in front of the two microphones to cut down the sound collection effect at the side of the two microphones, the difference of the receiving region of the microphone array changes according to the change of the position of the microphone array, as exemplified above, the microphone array corresponds to the vertical screen usage mode when it is in the first position, and the microphone array corresponds to the horizontal screen usage mode when it is in the second position.

Therefore, when the microphone array is needed to be adjusted from the vertical screen usage mode to the horizontal screen usage mode, the position of the first group of microphone array is adjusted from the first position to the second position.

Step 202, generating a first mode switch instruction when the position of the first group of microphone array is adjusted to the second position.

A mode switch instruction is triggered to be generated when the position of the first group of microphone array is adjusted to the second position.

Step 203 is executed after generating the mode switch instruction.

Step 203, adjusting the microphone array from the first usage mode to the second usage mode according to the first mode switch instruction.

The above situation is the specific procedure of the microphone array switching from the first usage mode to the second usage mode in case that there is only one group of microphone array in the mobile phone.

The second kind:

When there are at least two groups of microphone arrays in the mobile phone.

That is, there are at least two groups of microphone arrays including the second group of microphone array and the third group of microphone array in the mobile phone.

At this time, adjusting the microphone array from the first usage mode to the second usage mode according to control instruction also has two kinds of methods.

The first kind:

The first kind of method is determining the microphone array being used from the at least two groups of microphone arrays and then adjusting the usage mode of the microphone array being used to adjust it to usage mode suitable for the usage status of the mobile phone.

Figure 4:
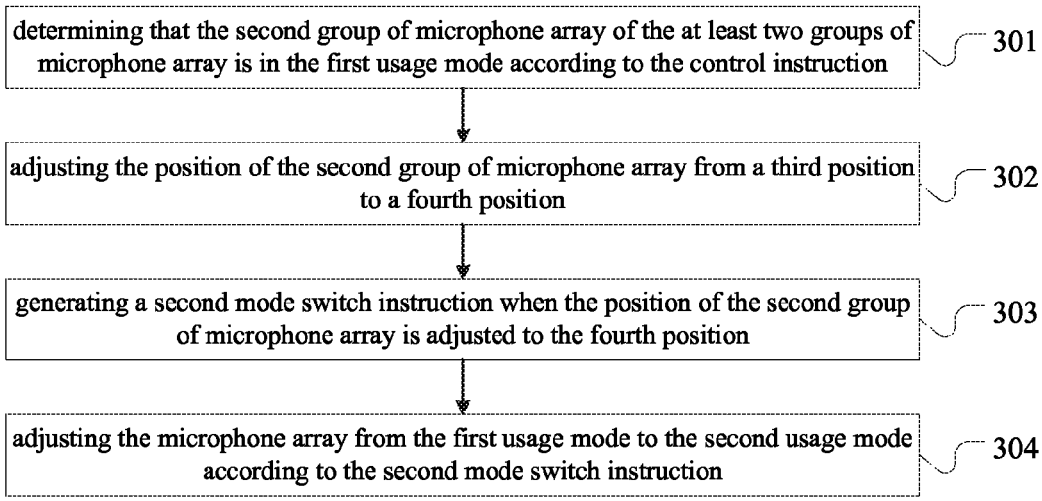
FIG. 4 is a flow chart of another method of adjusting the microphone array from the first usage mode to the second usage mode in the embodiment of this application.

As shown in FIG. 4, it specifically includes:

Step 301, determining that the second group of microphone array of the at least two groups of microphone arrays is in the first usage mode according to the control instruction.

When there are at least two groups of microphone arrays in the mobile phone, if the user makes a phone call as the mobile phone being in the vertical screen usage status, which microphone array out of the microphone arrays is in vertical screen usage mode is firstly determined, therefore, it determines that the microphone array is in the vertical screen usage mode according to the control instruction, that is, the second group of microphone array is in the vertical screen usage mode.

Step 302, adjusting the position of the second group of microphone array from the third position to the fourth position.

As mentioned above, the receiving region of the second group of microphone array is varied, and it changes according to the change of the position of the microphone array, as exemplified above, when the microphone array is in the third position, it corresponds to the vertical screen usage mode, and when the microphone array is in the fourth position, it corresponds to the horizontal screen usage mode.

Therefore, when the microphone array needs to be adjusted from the vertical screen usage mode to the horizontal screen usage mode, the position of the first group of microphone array is adjusted from the third position to the fourth position.

Step 303, generating a second mode switch instruction when the position of the second group of microphone array is adjusted to the fourth position.

Step 304, adjusting the microphone array from the first usage mode to the second usage mode according to the second mode switch instruction.

The second kind:

The second kind of method for adjusting is determining the microphone array corresponding to status to be used by the mobile phone according to the control instruction from the at least two groups of microphone arrays, for example, the mobile phone is to be adjusted to the horizontal screen usage status, therefore, the microphone array corresponding thereto is firstly determined according to the control instruction to start the function of the corresponding microphone array.

Figure 5:
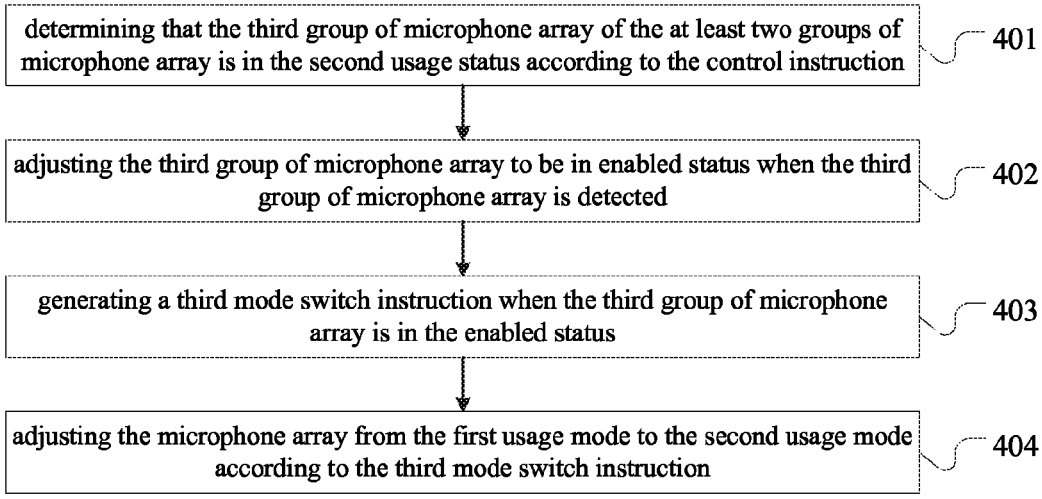
FIG. 5 is a flow chart of yet another method of adjusting the microphone array from the first usage mode to the second usage mode in the embodiment of this application.

As shown in FIG. 5, it is specifically as follows:

Step 401, determining that the third group of microphone array of the at least two groups of microphone arrays is in the second usage status according to the control instruction.

Step 402, adjusting the third group of microphone array to be in enabled status when the third group of microphone array is detected.

Step 403, generating the third mode switch instruction when the third group of microphone array is in the enabled status.

Step 404, adjusting the microphone array from the first usage mode to the third usage mode according to the third mode switch instruction.

In addition to it, the method further comprises step of: adjusting the second group of microphone array to be in disabled status.

It is to be noted that the above embodiments are only preferable embodiments of this application for describing and explaining the present invention, and does not limit the present invention, in practical application, the hand-held electronic apparatus may not only have the vertical screen usage status and horizontal screen usage status exemplified above, but also have usage status of multi-angle converted, for example, the usage status that the hand-held electronic apparatus is adjusted from the vertical screen usage status to usage status of tilting by 45 degree, therefore, the microphone array also has usage mode corresponding to the usage status of the hand-held electronic apparatus, and when the hand-held electronic apparatus detects the change of the usage status, the usage mode of the microphone array changes along with the usage status of the hand-held electronic apparatus in real time, for example, the microphone array is adjusted from vertical screen usage mode to usage mode of tilting by 45 degree along with the change of the usage status of the hand-held electronic apparatus.

The above embodiments are able to change the direction and position of the sound collection at any time according to the usage status of the hand-held electronic apparatus by obtaining a control instruction when the usage status of the hand-held electronic apparatus changes and adjusting the usage mode of the microphone array according to the control instruction in real time, so that it can ensure the best effect achieved as collecting the sound information at any position.

Further, when the usage mode of the microphone array is adjusted, there are various adjusting manners, and it is possible to select different adjusting manners according to different situations, which has a technical effect of flexible selection.

Embodiment two:

In this embodiment of this application, there provides a hand-held electronic apparatus.

Figure 6:
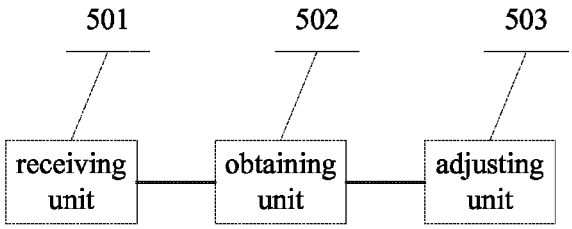
FIG. 6 is a schematic diagram of the electronic apparatus in the embodiment of this application.

The hand-held electronic apparatus has a microphone array, the microphone array including at least two kinds of usage modes, and the microphone array being in the first usage mode of the at least two kinds of usage modes when the hand-held electronic apparatus is in the first usage status, as shown in FIG. 6, the hand-held electronic apparatus includes:

A receiving unit 501 for receiving an adjustment signal for adjusting the hand-held electronic apparatus from the first usage status to the second usage status.

Wherein, the second usage status is different from the first usage status.

An obtaining unit 502 for obtaining a control instruction when the hand-held electronic apparatus is adjusted to the second usage status.

An adjusting unit 503 for adjusting the microphone array from the first usage mode to the second usage mode according to the control instruction, wherein, the second usage mode is different from the first usage mode and corresponds to the second usage status.

Further, when there is only the first group of microphone array in the hand-held electronic apparatus, the adjusting unit 503 specifically includes:

A first adjusting subunit for adjusting the position of the first group of microphone array from the first position to the second position according to the control instruction.

A first generating unit for generating a first mode switch instruction when the position of the first group of microphone array is adjusted to the second position.

A second adjusting subunit for adjusting the microphone array from the first usage mode to the second usage mode according to the second mode switch instruction.

Further, when there are at least two groups of microphone arrays including the second group of microphone array and the third group of microphone array in the hand-held electronic apparatus, the adjusting unit 503 specifically includes:

A first determining unit for determining that the second group of microphone array of the at least two groups of microphone arrays is in the first usage mode according to the control instruction.

A third adjusting subunit for adjusting the position of the second group of microphone array from the third position to the fourth position.

A second generating unit for generating a second mode switch instruction when the position of the second group of microphone array is adjusted to the fourth position.

A fourth adjusting subunit for adjusting the microphone array from the first usage mode to the second usage mode according to the fourth mode switch instruction.

Further, when there are at least two groups of microphone arrays including the second group of microphone array and the third group of microphone array in the hand-held electronic apparatus, the adjusting unit 503 further includes specifically:

A second determining unit for determining that the third group of microphone array of the at least two groups of microphone arrays is in the second usage status according to the control instruction.

A fifth adjusting subunit for adjusting the third group of microphone array to be in enabled status when the third group of microphone array is detected.

A third generating unit for generating the third mode switch instruction when the third group of microphone array is in the enabled status.

A sixth adjusting subunit for adjusting the microphone array from the first usage mode to the second usage mode according to the sixth mode switch instruction.

Still, the adjusting unit 503 further includes:

A seventh adjusting subunit for adjusting the second group of microphone array to be in disabled status.

With one or more embodiments of the present invention, the following technical effect can be achieved:

The above one or more of embodiments is able to change the direction and position of the sound collection at any time according to the usage status of the hand-held electronic apparatus by obtaining a control instruction when the usage status of the hand-held electronic apparatus changes and adjusting the usage modes of the microphone array according to the control instruction in real time, so that it can ensure the best effect achieved as collecting the sound information at any position.

Further, when the usage mode of the microphone array is adjusted, there are various adjusting manners, and it is possible to select different adjusting manners according to different situations, which has a technical effect of flexible selection.

It is obvious that those skilled in the art can make various kinds of modifications and variations to the present invention without departing from the spirit and scope of the present invention. Thus, if these modifications and variations of the present invention fall within the scope of the claims of the present invention and the equivalent technology, the present invention intends to comprise these modifications and variations.

The invention claimed is:

1. A data processing method applied in a hand-held electronic apparatus that has a microphone array, which includes at least two kinds of usage modes, with the microphone array being in a first usage mode of the at least two kinds of usage modes when the hand-held electronic apparatus is in a first usage status, the method comprising:

receiving an adjustment signal to adjust the hand-held electronic apparatus from the first usage status to a second usage status, wherein, the second usage status is different from the first usage status;

obtaining a control instruction when the hand-held electronic apparatus is adjusted to the second usage status; and, adjusting the microphone array from the first usage mode to the second usage mode according to the control instruction, wherein, the second usage mode is different from the first usage mode and corresponds to the second usage status, wherein when there is only a first group of microphones in the microphone array in the hand-held electronic apparatus, the adjusting the microphone array from the first usage mode to the second usage mode according to the control instruction is specifically adjusting the position of the first group of microphones in the microphone array from a first position to a second position according to the control instruction;

generating a first mode switch instruction when the position of the first group of microphones in the microphone array is adjusted to the second position;

adjusting the microphone array from the first usage mode to the second usage mode according to the first mode switch instruction.

2. The method according to claim 1, wherein when there are at least two groups of microphones including a second group of microphones and a third group of microphones in the microphone array in the hand-held electronic apparatus, the adjusting the microphone array from the first usage mode to the second usage mode according to the control instruction comprises:

determining that the second group of microphone array of the at least two groups of microphones in the microphone array is in the first usage mode according to the control instruction;

adjusting the position of the second group of microphone array from a third position to a fourth position;

generating a second mode switch instruction when the position of the second group of microphones is adjusted to the fourth position; and, adjusting the microphone array from the first usage mode to the second usage mode according to the second mode switch instruction.

3. The method according to claim 1, wherein when there are at least two groups of microphones including a second group of microphones and a third group of microphones in the microphone array in the hand-held electronic apparatus, the adjusting the microphone array from the first usage mode to the second usage mode according to the control instruction further comprises:

determining that the third group of microphone array of the at least two groups of microphones in the microphone array is in the second usage status according to the control instruction;

adjusting the third group of microphones to be in enabled status when the third group of microphone array is detected;

generating a third mode switch instruction when the third group of microphone array is in the enabled status; and, adjusting the microphone array from the first usage mode to the second usage mode according to the third mode switch instruction.

4. The method according to claim 3, wherein after adjusting the third group of microphones to be in the enabled status, the method further comprises a step of adjusting the second group of microphones to be in disabled status.

5. A hand-held electronic apparatus having a microphone array that includes at least two kinds of usage modes, with the microphone array being in a first usage mode of the at least two kinds of usage modes when the hand-held electronic apparatus is in a first usage status, the hand-held electronic apparatus comprising:

a receiving unit for receiving an adjustment signal to adjust the hand-held electronic apparatus from the first usage status to a second usage status, wherein, the second usage status is different from the first usage status;

an obtaining unit for obtaining a control instruction when the hand-held electronic apparatus is adjusted to the second usage status; and, an adjusting unit for adjusting the microphone array from the first usage mode to the second usage mode according to the control instruction, wherein, the second usage mode is different from the first usage mode and corresponds to the second usage status, wherein when there is only a first group of microphones in the microphone array in the hand-held electronic apparatus, the adjusting unit specifically includes a first adjusting subunit for adjusting the position of the first group of microphones from a first position to a second position according to the control instruction;

a first generating unit for generating a first mode switch instruction when the position of the first group of microphones is adjusted to the second position;

a second adjusting subunit for adjusting the microphone array from the first usage mode to the second usage mode according to the first mode switch instruction.

6. The hand-held electronic apparatus according to claim 5, wherein when there are at least two groups of microphones including the second group of microphones and the third group of microphones in the microphone array in the hand-held electronic apparatus, the adjusting unit comprises:

a first determining unit for determining that the second group of microphone array of the at least two groups of microphones in the microphone arrays is in the first usage mode according to the control instruction;

a third adjusting subunit for adjusting the position of the second group of microphones from a third position to a fourth position;

a second generating unit for generating a second mode switch instruction when the position of the second group of microphones is adjusted to the fourth position; and a fourth adjusting subunit for adjusting the microphone array from the first usage mode to the second usage mode according to the second mode switch instruction.

7. The hand-held electronic apparatus according to claim 5, wherein when there are at least two groups of microphones including a second group of microphones and a third group of microphones in the microphone array in the hand-held electronic apparatus, the adjusting unit further comprises:

a second determining unit for determining that the third group of microphones of the at least two groups of microphones in the microphone array is in the second usage status according to the control instruction;

a fifth adjusting subunit for adjusting the third group of microphones to be in enabled status when the third group of microphones is detected;

a third generating unit for generating a third mode switch instruction when the third group of microphone array is in the enabled status; and a sixth adjusting subunit for adjusting the microphone array from the first usage mode to the second usage mode according to the third mode switch instruction.

8. The hand-held electronic apparatus according to claim 7, wherein the adjusting unit further comprises a seventh adjusting subunit for adjusting the second group of microphones to be in disabled status.

* * * * *